US005588541A

United States Patent [19]

Goetz

[11] Patent Number: 5,588,541

[45] Date of Patent: Dec. 31, 1996

[54] HEAVY-DUTY DECORATIVE SHELVING

[75] Inventor: Charles R. Goetz, Carnegie, Pa.

[73] Assignee: Alco Industries, Inc., Valley Forge, Pa.

[21] Appl. No.: 318,074

[22] Filed: Oct. 5, 1994

[51] Int. Cl.[6] ..... A47B 47/00

[52] U.S. Cl. ..... 211/188; 211/186; 211/189; 211/194; 312/334.23

[58] Field of Search ..... 211/189, 186, 211/187, 133, 175, 86, 188; 108/192, 193, 180, 64; 312/330.1, 334.23, 114, 140; D6/396, 449, 495, 499, 479, 509

[56] References Cited

U.S. PATENT DOCUMENTS

| | | | |
|---|---|---|---|
| D. 91,769 | 3/1934 | Duval . | |
| D. 233,294 | 10/1974 | Goulder | D6/186 |
| D. 239,352 | 3/1976 | Petrick | D6/179 |
| D. 239,901 | 5/1976 | Goulder | D6/186 |
| D. 239,902 | 5/1976 | Goulder | D6/186 |
| D. 303,596 | 9/1989 | Goetz | D6/479 |
| D. 303,885 | 10/1989 | Goetz | D6/484 |
| D. 304,398 | 11/1989 | Goetz | D6/479 |
| D. 321,101 | 10/1991 | Zucker | D6/479 |
| D. 325,138 | 4/1992 | Levin | D6/479 |
| D. 325,680 | 4/1992 | Kiiski | D6/479 |
| D. 330,652 | 11/1992 | Goetz | D6/479 |
| D. 355,798 | 2/1995 | Goetz | D6/479 |
| 2,246,448 | 6/1941 | Mahan, Jr. | 25/153 |
| 2,510,243 | 6/1950 | Mohring | 211/148 |
| 3,039,621 | 6/1962 | Pilcher | 211/147 |
| 3,549,020 | 12/1970 | Von Bohr | 211/148 |
| 3,684,285 | 8/1972 | Kane | 211/188 |
| 4,321,873 | 3/1982 | Nealis | 108/91 |
| 4,574,709 | 3/1986 | Lackey et al. | 211/186 |
| 4,709,642 | 12/1987 | Briosi | 108/111 |
| 4,792,195 | 12/1988 | Adriaansen et al. | 312/330.1 |
| 4,930,643 | 6/1990 | Flum | 211/188 |
| 4,940,150 | 7/1990 | Spengler | 211/188 |
| 4,989,519 | 2/1991 | Welsch et al. | 108/111 |
| 5,149,026 | 9/1992 | Allen | 248/68.1 |
| 5,149,027 | 9/1992 | Weber | 248/68.1 |
| 5,158,187 | 10/1992 | Taub | 211/186 |
| 5,218,914 | 6/1993 | Dickinson | 108/64 |

OTHER PUBLICATIONS

*Design–A–Wall Catalog*, All–Luminum Products, Inc., p. 6.

*Galleried Corner Etagere*, The Sturbridge Yankee Workshop Catalog, Jul. 2, 1984, p. 4.

*Primary Examiner*—Karen J. Chotkowski

*Assistant Examiner*—Anita M. King

*Attorney, Agent, or Firm*—Webb Ziesenheim Bruening Logsdon Orkin & Hanson, P.C.

[57] ABSTRACT

The modular shelf system disclosed allows for shelf construction of varying heights and/or configurations. The modular shelf system includes a first set of shelf members spaced vertically from each other and a second set of shelf members spaced vertically from each other. A plurality of interlocking leg members is coupled to the shelf members for supporting and spacing the shelf members vertically from each other. A shelf connecting clip is provided for connecting at least one shelf member of the first set to a horizontally adjacent shelf member of the second set. A slidable drawer may be supported by one of the shelf members.

14 Claims, 5 Drawing Sheets

HEAVY-DUTY DECORATIVE SHELVING

BACKGROUND OF THE INVENTION

1. Field of the Invention

The present invention relates to heavy-duty decorative shelving, more specifically toward a modular shelf system which allows construction of a shelf assembly in various configurations.

2. Background Information

A single shelving configuration has been found to be ineffective for meeting various shelving requirements. Consequently, a wide variety of shelving unit adaptations have been developed. Many shelving units allow the user to reposition shelf locations within a cabinet to obtain the desired number and spacing of shelves within the unit. Alternatively, modular shelf systems have been developed which allow the user to build the number of particular shelves needed. However, the modular systems previously known have not adequately provided for altering the overall configuration of the shelving unit while additionally maintaining simple, durable construction which is easily manufactured.

It is the object of the present invention to overcome the aforementioned drawbacks of the prior art. The object of the present invention is to provide a heavy-duty, decorative modular shelving arrangement which provides for a wide variety of assembled configurations, which minimizes the number of components to the system and which maintains structural integrity of the system.

SUMMARY OF THE INVENTION

The objects of the present invention are achieved by providing a modular shelf system which includes at least a first set of shelf members spaced vertically from each other. A plurality of leg members is coupled to the respective shelf members for spacing the shelf members vertically from each other. Each leg member includes a supporting shoulder configured to support one of the shelf members positioned on top of the shoulder. Each leg member further includes a leg engaging portion configured for interlocking the leg member with a vertically adjacent leg member positioned above the supported shelf member. A second set of shelf members spaced vertically from each other may be provided. A connecting device may be provided for connecting at least one shelf member of the first set to a horizontally adjacent shelf member of the second set.

In one embodiment of the present invention, a first set of shelf members includes a plurality of substantially rectangular shelf members and the second set includes a plurality of substantially pie-shaped, preferably quadrant-shaped, shelf members spaced vertically from each other. The provision of rectangular shelf members and quadrant-shaped shelf members allows for a large number of configuration varieties with a minimum number of elements while still maintaining the overall heavy-duty shelf construction.

Specifically, the provision of rectangular shelf members together with the quadrant-shaped shelf members allows for the construction of shelf assemblies having rounded end portions or shelf assemblies which are configured to extend in 90° angles with respect to individual shelf members of the shelf assembly, such as for bending around corners of a wall in a room. It is also anticipated that the rectangular and pie-shaped members may be utilized individually to form rectangular, circular or semicircular shelf assemblies.

Each shelf member of the present invention may be formed as an integral, one-piece injected-molded shelf member which includes a horizontal base member and a vertical side member surrounding the peripheral edge of the base member. A top edge of the vertical side member is positioned above the base member. A plurality of aligned upper and lower leg cavities, each adapted to receive a leg member therein, may be positioned in each corner of the shelf member to form a beveled corner portion for the shelf member.

The shelf connecting device may include an inverted U-shaped clip extending over vertical side members of horizontally adjacent shelf members and further received in slots positioned in horizontal base members of each shelf member. This connecting clip arrangement provides a simple, effective mechanism for securing the horizontally adjacent shelf members to each other to integrate the overall shelf assembly. The present invention may further include reinforcing ribs positioned on the underside of each of the shelf members. Additionally, central post-receiving depressions may be provided in the shelf members to allow for the placement of an additional support post, if needed. The present invention may additionally include cap members on the uppermost and lowermost shelf members of the system as well as a slidable drawer suspended from one of the shelf members.

These and other advantages of the modular shelf system according to the present invention will be clarified in the description of the preferred embodiments described in connection with the attached figures.

BRIEF DESCRIPTION OF THE DRAWINGS

FIG. 1O is a section view of the portion of the modular shelf system illustrated in FIG. 8.

DESCRIPTION OF THE PREFERRED EMBODIMENTS

Figure 1:
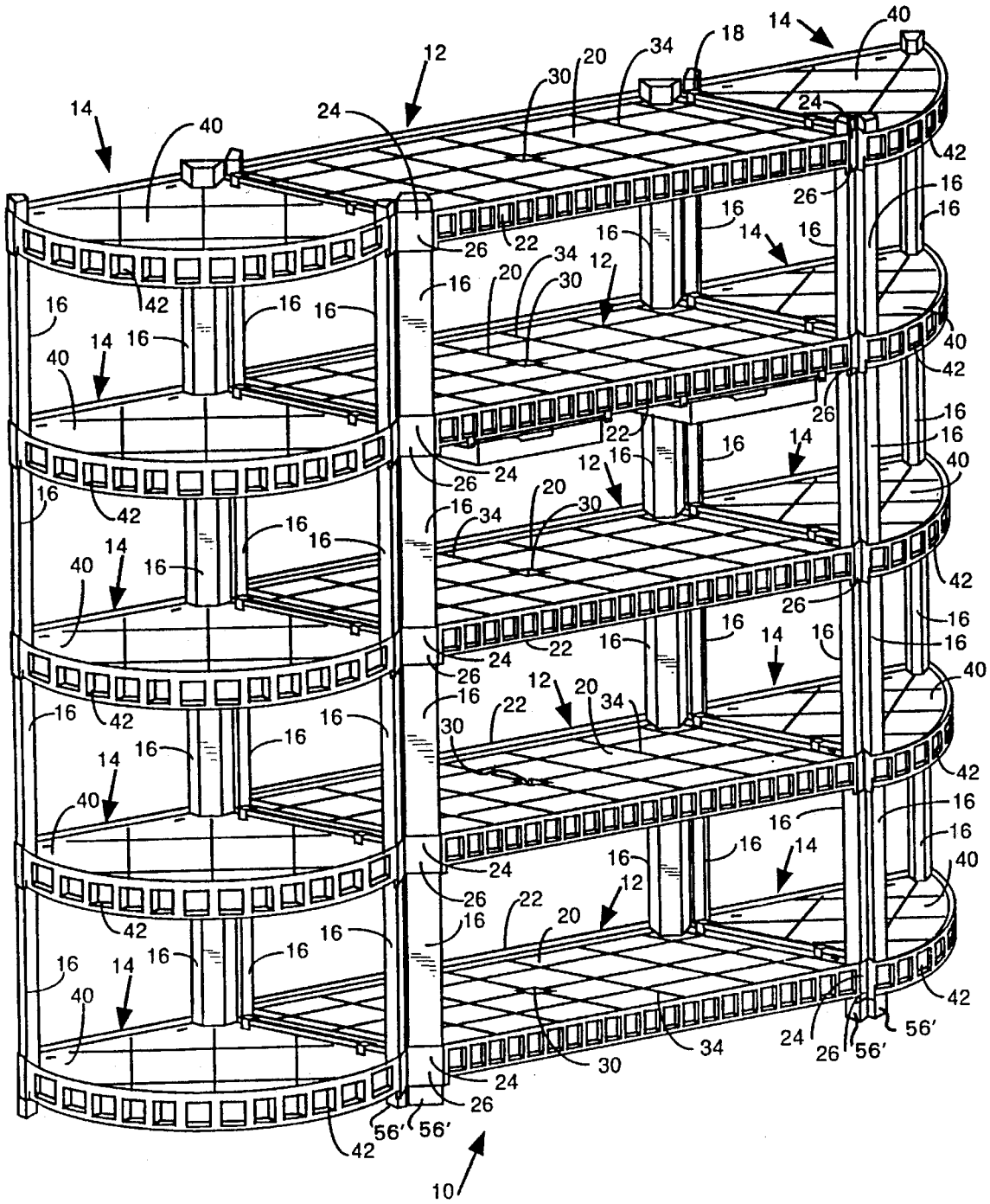
FIG. 1 is a perspective view of a modular shelf system according to the present invention.

A modular shelf system 10 according to the present invention is illustrated in FIG. 1. The modular shelf system 10 of the present invention preferably includes at least one set of substantially rectangular shelf members 12 vertically spaced from each other and at least one set of generally pie-shaped shelf members 14 vertically spaced from each other. Leg members 16 are coupled to the shelf members 12 and 14 for spacing the shelf members 12 and 14 from each other, respectively. A shelf connecting clip 18 is used for connecting horizontally adjacent shelf members 12 and 14. The specific shelf arrangement illustrated in FIG. 1 includes one set of rectangular shelf members 12 and two sets of pie-shaped shelf members 14. It should be understood from the present invention that a wide variety of combinations and configurations are available with the modular shelf system 10 according to the present invention.

Figure 2:
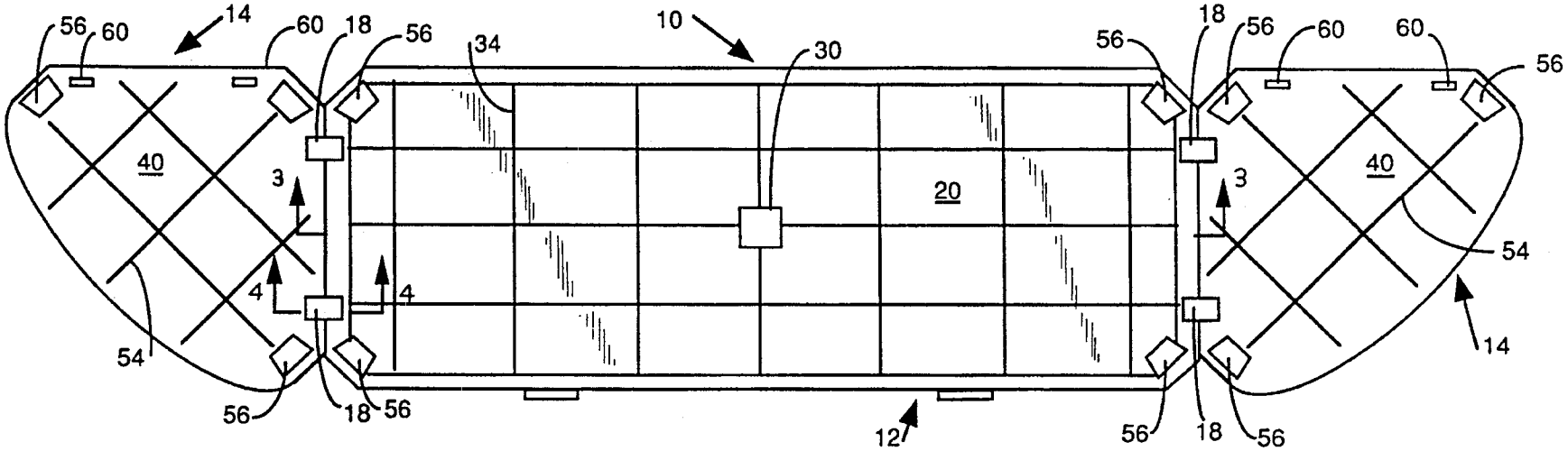
FIG. 2 is a top view of the modular shelf system illustrated in FIG. 1.
Figure 6:
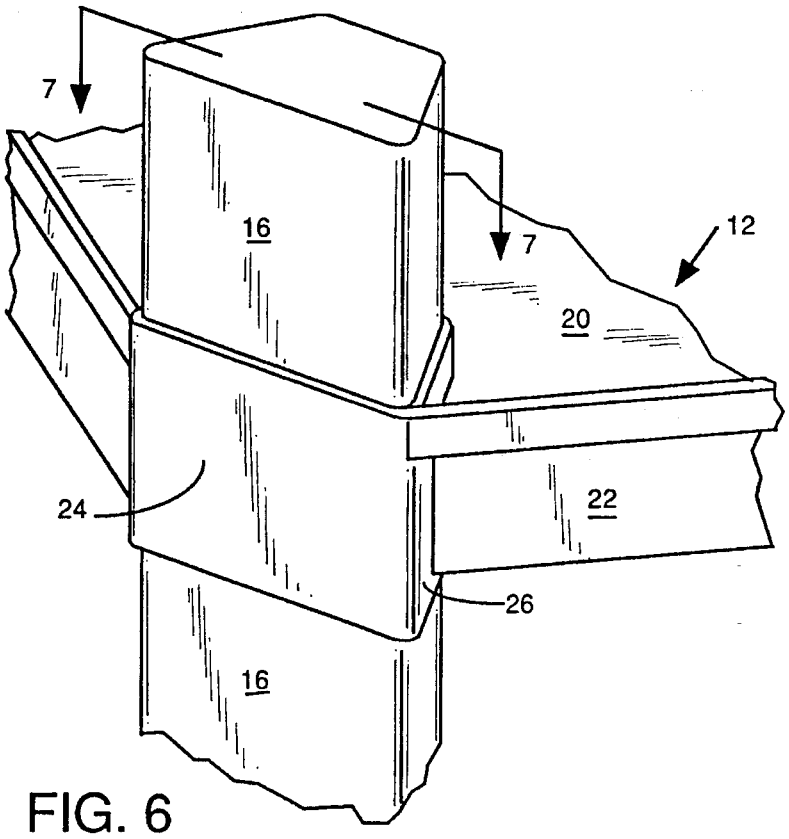
FIG. 6 is an enlarged perspective view of a portion of the molar shelf system illustrated in FIG. 1.
Figure 7:
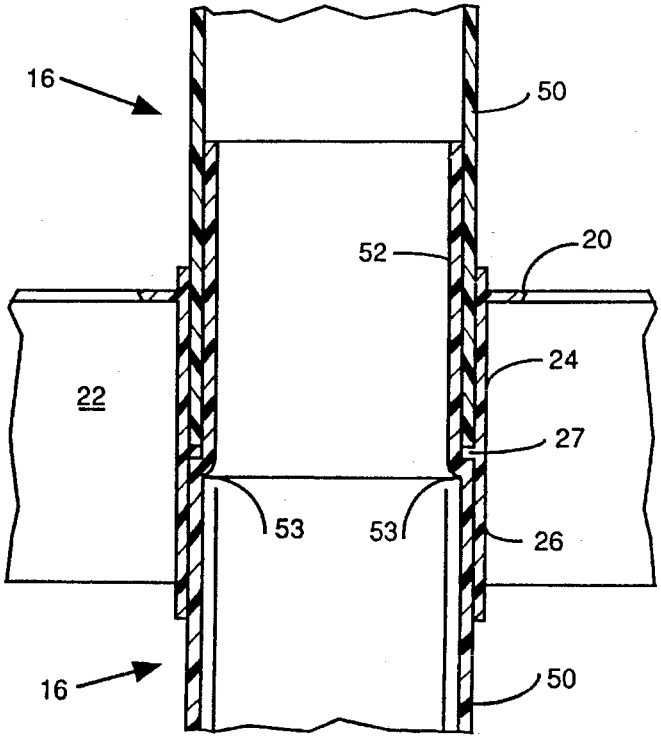
FIG. 7 is an enlarged section view of a portion of the modular shelf system illustrated in FIG. 6 taken along line 7—7.

The rectangular shelf member 12 is preferably formed as an injection molded integral, one-piece shelf which includes a horizontal base member 20. A vertical side member 22 surrounds the peripheral edge of the substantially rectangular horizontal base member 20. A top edge of the vertical side member 22 is positioned above the horizontal base member 20 and is most clearly illustrated in FIGS. 4 and 5. At least the portions of the vertical side member 22 extending along the longer sides of the rectangular shelf member 12 include a decorative face, as illustrated in FIG. 1. The decorative face will generally form at least the front of the shelf assembly. Four upper leg cavities 24 and four lower leg cavities 26 are each configured for receiving interlocking leg members 16 therein, as best illustrated in FIGS. 6 and 7. A leg supporting lip 27 separates the upper leg cavity 24 from the lower leg cavity 26 forming a stop for the appropriate leg members 16, as will be described hereinafter. An upper leg cavity 24 is positioned and aligned with a lower leg cavity 26 in each corner of the rectangular shelf member 12 to form a beveled corner portion for the rectangular shelf member 12, as best shown in FIGS. 1 and 2. The provision of a beveled corner on the rectangular shelf member 12 eliminates sharp corners in the shelf assembly which are more dangerous and more easily broken.

Figure 3:
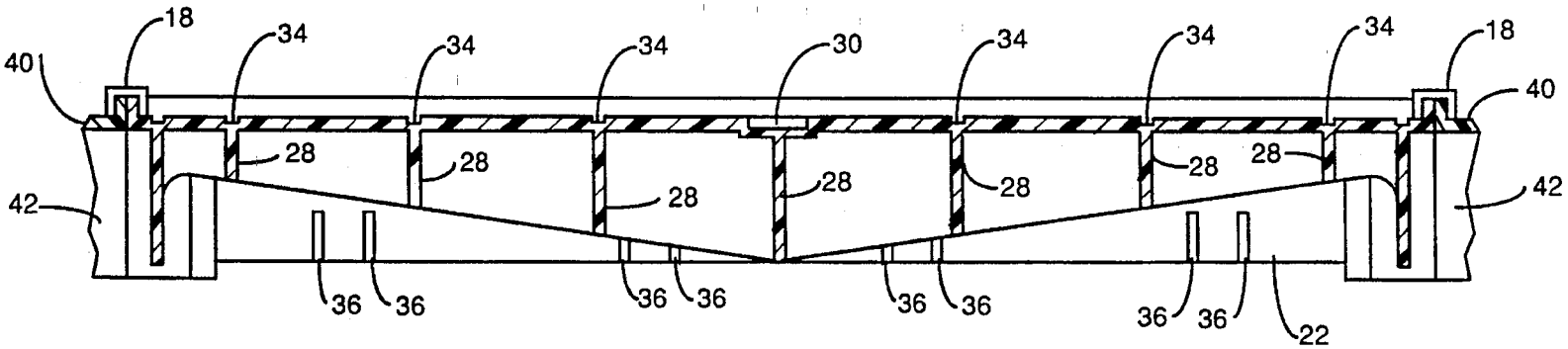
FIG. 3 a cross section of the modular shelf system illustrated in FIG. 2 taken along line 3—3.

The rectangular shelf member 12 includes reinforcing ribs 28 on the underside of the rectangular shelf member 12. As shown in FIG. 3, the reinforcing ribs 28 generally become more substantial in the center of the rectangular shelf member 12 where greater support is needed. The reinforcing ribs 28 run the length and width of the rectangular shelf member 12 in a grid-like pattern. The rectangular shelf member 12 includes an upper post-receiving depression 30 in a substantially central location of the horizontal base member 20. The upper post-receiving depression 30 allows for the insertion of a supporting post in the central portion of the shelf to provide additional support, if needed. The rectangular shelf member 12 may be modified to include a lower central post-receiving depression aligned with the upper post-receiving depression. This would provide for easy, secure placement of a supplemental support post. As illustrated in FIG. 1, the upper surface of the horizontal base member 20 includes grooves 34. The grooves 34 are in a grid-like pattern and are generally aligned with the underlying ribs 28. Additionally, a plurality of pairs of bracket ridges 36 is provided at appropriately spaced locations on a back surface of the vertical side member, as shown in FIG. 3. Each pair of bracket ridges 36 is configured to receive a drawer mounting bracket therein, as will be described hereinafter.

The pie-shaped shelf member 14 includes a horizontal base member 40 which is in the shape of a 90° quadrant, as illustrated in FIG. 1. A vertical side member 42 surrounds the peripheral edge of the horizontal base member 40 with the top edge of the vertical side member 42 positioned above the horizontal base member 40, as most clearly illustrated in FIGS. 4 and 5. As shown in FIG. 1, the flat sides of the pie-shaped shelf member 14 are substantially the same length as one of the sides of the rectangular shelf member 12. Preferably, at least the curved portion of the vertical side member includes a decorative face matching the decorative face of the rectangular shelf member 12 to improve the overall appearance of the shelf assembly. Three upper leg cavities 44 and three lower leg cavities 46 are provided on each pie-shaped shelf member 14. Each leg cavity 44 and 46 is configured for receiving a leg member 16 therein, as illustrated in FIG. 1. An upper leg cavity 44 and a lower leg cavity 46 are aligned with each other and include a leg supporting lip (not shown) in exactly the same manner as the upper and lower leg cavities 24 and 26. The upper and lower leg cavities 44 and 46 are positioned in each corner of the pie-shaped shelf member 14 to form a beveled corner portion for the pie-shaped shelf member 14. The pie-shaped shelf member 14 preferably includes reinforcing ribs 48, shown in FIG. 5, substantially the same as the ribs 28 shown in connection with the rectangular shelf member 12. The horizontal base member 40 includes grooves 54 on an upper surface thereof which are aligned with the ribs 28 positioned underneath the horizontal base member 40.

As shown in FIGS. 6 and 7, the leg members 16 have a generally trapezoidal cross section adapted to fit into each of the leg cavities 24, 26, 44 and 46. The leg members 16 are preferably of the same uniform length to maintain ease of assembly of the overall shelf assembly. However, various sets of leg members 16 may be manufactured having different lengths to allow for variations in shelf member spacing. The leg member 16 includes a lower end portion 50 having an outer cross section the same as the inner cross section of the upper leg cavities 24 and 44. A bottom of the lower end portion 50 abuts against and is supported by leg supporting lip 27. The upper end of the leg member 16 includes a leg engaging portion 52 having an outer cross section substantially equal to the inner cross section of the lower end portion 50. The leg engaging portion 52 is offset from the lower end portion forming a supporting shoulder 53. A portion of the lower end portion 50 is received in the lower leg cavity 26, whereby the supporting shoulder 53 abuts against the leg supporting lip 27 supporting the shelf member 12. The leg engaging portion 52 extends into the upper leg cavity 24 within the lower end portion 50 of the other leg member 16 to interlock the leg members 16, as shown in FIG. 7, and increase the stability of the modular shelf system 10. The present invention additionally includes upper cap members 56 received in the upper leg cavities 24 and 44 of the shelf members 12 and 14 positioned at the upper end of the shelf assembly, as shown in FIG. 1. The upper cap members 56 have the same cross section and configuration as the lower end portion 50 of leg member 16, but are of a shorter length. Lower cap members 56' may be provided beneath the lowest shelf members 12 and 14 to raise the lowest shelf members 12 and 14 off the ground. The lower cap members 56' include a leg engaging portion 52, a supporting shoulder 53 and a shortened lower end portion 50.

Figure 4:
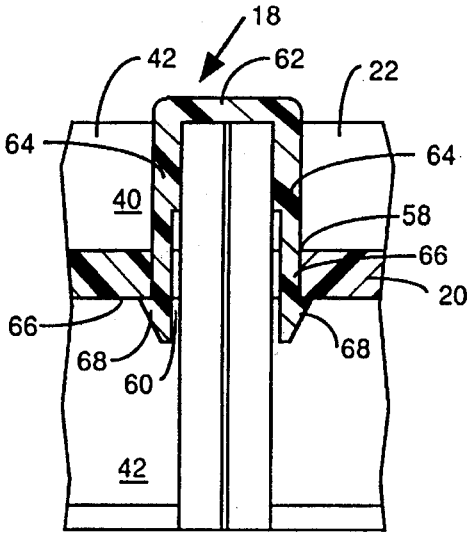
FIG 4 is an enlarged section view of a portion of the modular shelf system illustrated in FIG. 2 taken along line 4—4.
Figure 5:
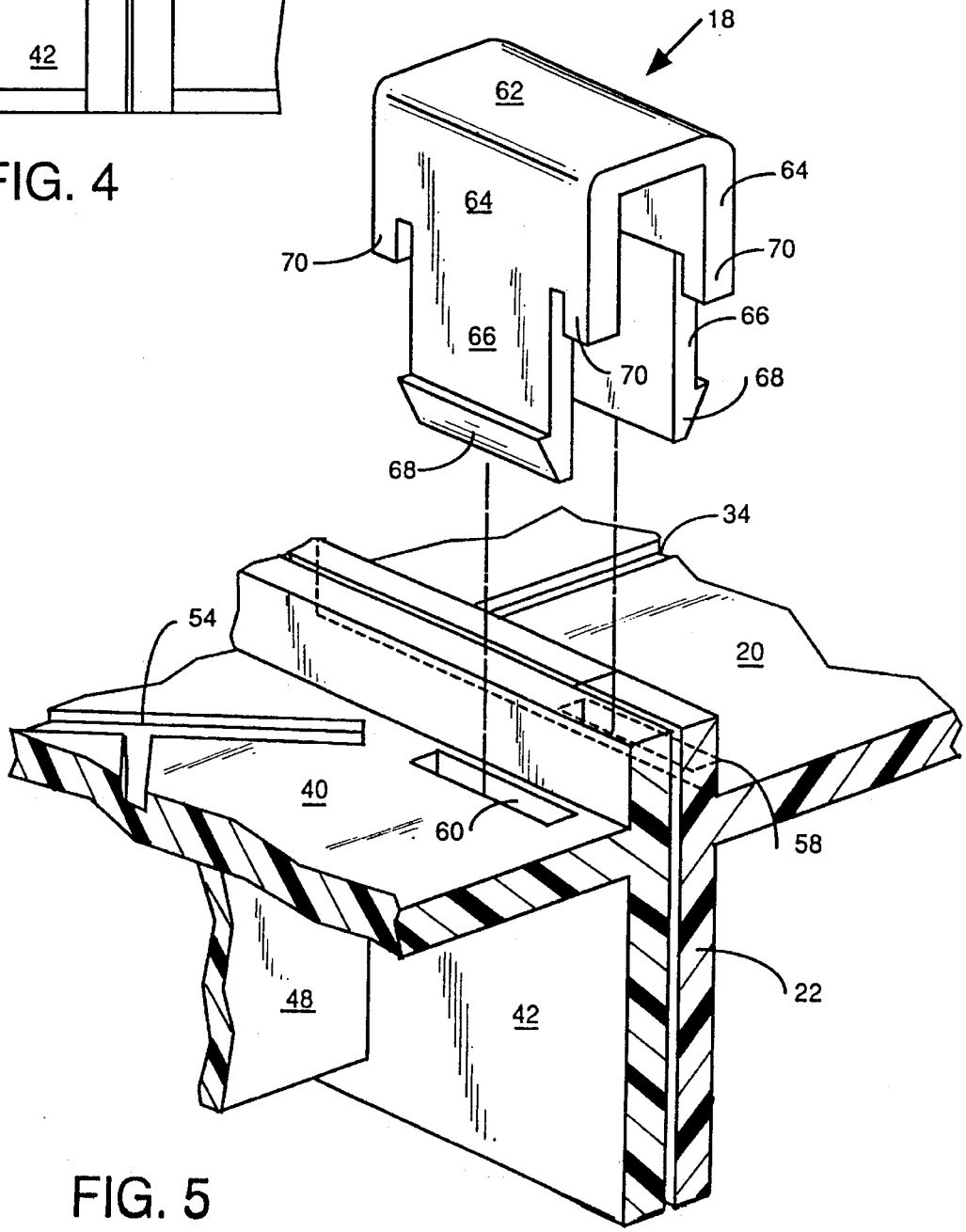
FIG. 5 is an enlarged exploded view, partially in section, of portion of the modular shelf system illustrated in FIG. 4.

The shelf connecting clip 18 is most clearly illustrated in FIGS. 4 and 5. The shelf connecting clip 18 extends over the vertical side members 22 and 42 through slots 58 and 60 formed in the horizontal base members 20 and 40, respectively. The shelf connecting clip 18 includes a generally flat top 62, a pair of flat, generally parallel upper sides 64 attached to opposed ends of flat top 62, a flat lower extension 66 attached to a lower end of each upper side 64 and a securing flange 68 attached to a lower end of each lower extension 66. The flat lower extensions 66 extend through the slots 58 and 60 and have a thickness less than the thickness of the top 62 and upper sides 64 to provide a greater degree of flexibility. A portion of the securing flange 68 extends away from the outer surface of the lower extension 66, whereby the securing flange 68 will engage an underside of the horizontal base members 20 and 40, respectively, as shown in FIG. 4. The securing flange 68 is inwardly tapered in a direction extending away from the lower extension 66 to ease the pushing of the lower extensions 66 and securing flanges 68 through the slots 58 and 60. The lower extension 66 has a width approximately equal to the width of slots 58 and 60 and less than the width of the upper side 64. The lower extension 66 is centered on the upper side 64 between a pair of stop members 70 which are attached to the lower end of the upper side 64. The horizontal base member 20 or 40 will be positioned between the securing flange 68 and the stop member 70. This simple construction allows for securely fastening adjacent horizontal shelf members 12 and 14. As illustrated in FIG. 1, preferably two shelf connecting clips 18 are utilized to secure horizontally adjacent shelf members 12 and 14. A pair of slots 58 is provided on each end of the horizontal base members 20. A pair of slots 60 is provided on each flat side of the horizontal base members 40. This construction will allow for a wide variety of configurations for combining the sets of rectangular shelf members 12 with the sets of pie-shaped shelf members 14. Additional slots 58 may be positioned along the long sides of the horizontal base member 20 to increase the variety of possible shelf assembly configurations.

Figure 8:
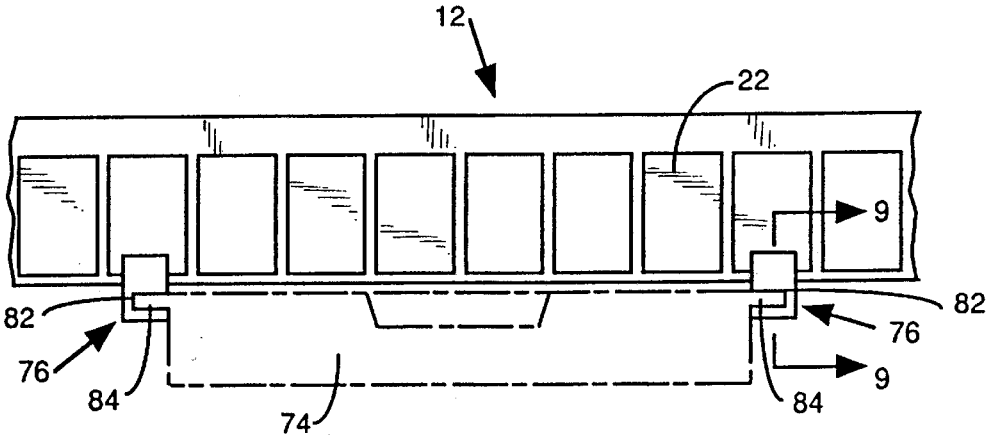
FIG. 8 is an enlarged front view of a portion of the modular shelf system illustrated in FIG. 1.
Figure 9:
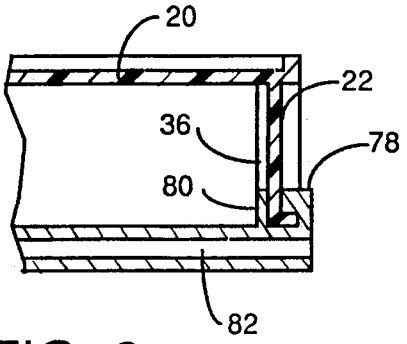
FIG. 9 is a section view of a portion of the modular shelf system illustrated in FIG. 8 taken along line 9—9.
Figure 10:
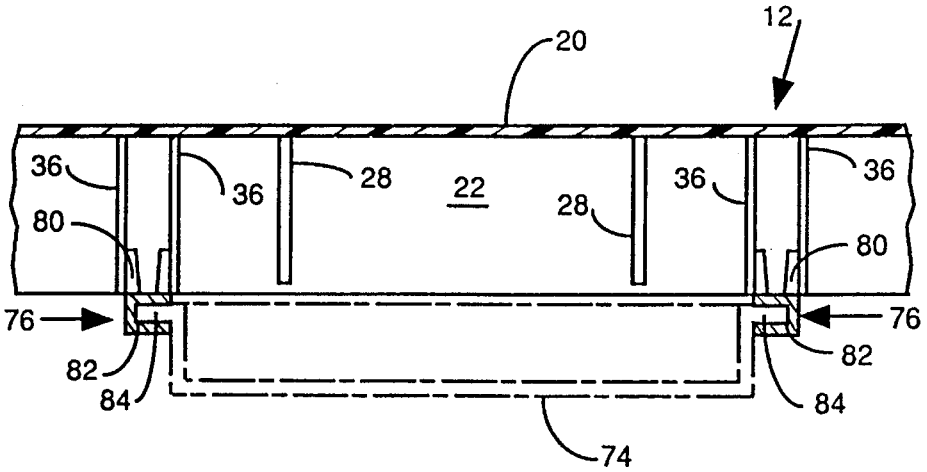

As shown in FIGS. 8–10, a drawer 74 is slidably positioned on a pair of the drawer mounting brackets 76 attached to the vertical side member 22 of the rectangular shelf member 12. Each drawer mounting bracket 76 is received between a pair of bracket ridges 36 and secured to the vertical side member 22. The pair of mounting brackets 76 allows for attachment of a drawer 74 to any of the rectangular shelf members 12 which are desired. Each mounting bracket 76 is attached to the vertical side member 22 at each end of the mounting bracket 76 by an overlapping snap-on type connector 78 and a locating flange 80 which is positioned between the bracket ridges 36 to locate the drawer 74. A shelf supporting groove 82 runs along the length of the mounting bracket 76. The drawer 74 is slidably supported between the mounting brackets 76 by a pair of supporting flanges 84 slidably received in one of the shelf supporting grooves 82.

In operation, the modular shelf system 10 has a minimum number of elements which combine to form a large variety of overall shelf assembly configurations while still providing a heavy-duty, durable shelf system. The interconnection between horizontally adjacent shelf members and the vertically adjacent leg members forms an integrated, sturdy, heavy-duty shelf assembly of a specific desired configuration. In certain shelf assembly configurations, a set of rectangular shelf members 12 may be connected by shelf connecting clips 18 to a horizontally adjacent set of rectangular shelf members 12 and, likewise, in other configurations adjacent sets of pie-shaped shelf members 14 will be coupled to each other. Additionally, in certain applications only one set of shelf members 12 or 14 may be needed.

Having described the components of the modular shelf system 10 according to the present invention, the present invention should not be limited to the embodiments specifically illustrated herein. It will be appreciated by those of ordinary skill in the art that various modifications may be made to the present invention without departing from the spirit and scope thereof. The scope of the present invention should be interpreted in connection with the attached claims.

What is claimed is:

1. A modular shelf system comprising:

at least one set of horizontal shelf members vertically spaced from each other, each said horizontal shelf member including a plurality of aligned upper and lower leg cavities and a leg supporting lip between said upper leg cavity and said lower leg cavity; and a plurality of leg members coupled to each said shelf member for spacing said shelf members from each other, wherein each said leg member is received in one said lower leg cavity and includes a supporting shoulder configured to abut against said leg supporting lip to support one of said shelf members which is positioned on top of said shoulder and a leg engaging portion extending into said upper leg cavity configured for interlocking said leg member with another said leg member positioned above said supported shelf member by being slidably received within said another leg member.

2. The shelf system of claim 1 wherein said leg engaging portion is positioned at an upper end of said leg member and has a smaller cross section than a lower end of said leg member, whereby an offset between said leg engaging portion and said lower end forms said supporting shoulder.

3. A modular shelf system comprising:

a first set of shelf members vertically spaced from each other;

a second set of shelf members vertically spaced from each other;

a plurality of leg members coupled to said shelf members for spacing said shelf members from each other, each said leg member including a supporting shoulder configured to support one said shelf member which is positioned on top of said shoulder and a leg engaging portion configured for interlocking said leg member with another said leg member positioned above said supported shelf member; and a shelf connecting means for connecting at least one shelf member of said first set to a horizontally adjacent shelf member of said second set;

wherein each said shelf member of said first set and second set includes a horizontal base member, and each said horizontal base member of said shelf member of said first set is substantially rectangular, and each said horizontal base member of said shelf member of said second set is non-rectangular, and wherein each said substantially rectangular shelf member includes reinforcing ribs positioned on an underside of said horizontal base member and an upper post-receiving depression on an upper side of said rectangular base member, said post-receiving depression configured for receiving a central shelf supporting post therein, and wherein said reinforcing ribs increase in height toward a center portion of said shelf.

4. The shelf system of claim 3 wherein each said shelf member is an integral, one-piece shelf member including:

a vertical side member surrounding a peripheral edge of said horizontal base member, wherein a top edge of said vertical side member is positioned above said horizontal base member;

a plurality of upper leg cavities configured to receive those of said leg members therein which are coupled to said shelf member and positioned above said shelf member; and a plurality of lower leg cavities aligned with said upper leg cavities, said lower leg cavities configured to receive those of said leg members therein which are coupled to said shelf member and positioned below said shelf member.

5. The shelf system of claim 4 wherein said shelf connecting means includes a plurality of identically shaped, generally inverted U-shaped clips, each said clip fastened over said top edges of said vertical side members of said horizontally adjacent shelf members.

6. The shelf system of claim 5 wherein said horizontal base members of each said shelf member include a plurality of rectangular slots, each said slot adapted for receiving a portion of one said clip.

7. The shelf system of claim 3 wherein said shelf connecting means includes a plurality of clips, wherein each said clip has a top, a bottom, a front, a back, and a pair of opposed sides, said clip further including:

a generally flat top member extending along said top and between said front and said back and between said opposed sides of said clip;

a pair of upper side members attached to opposed ends of said top member along said opposed sides, said pair of upper side members extending away from said top member toward said bottom, wherein said top member and said pair of upper side members have substantially the same thickness;

a lower extension attached to an end of each said upper side member which is spaced from said top, said lower extension extending away from said top and said upper side member toward said bottom, said lower extension having a thickness less than the thickness of said upper side members, wherein said top member, said upper side members and said lower extensions form an inverted U-shaped body, each said lower extension having a width measured along said side of said clip less than a width of each said upper side member measured along said side of said clip; and a securing flange attached to an end of each said lower extension which is spaced from said upper side member, a portion of said securing flange extending away from a flat outer surface of said lower extension, and wherein each said securing flange engages an underside of a corresponding one of said horizontal base members.

8. The shelf system of claim 3 wherein each said horizontal base member of said shelf member of said second set is a substantially pie-shaped sector.

9. The shelf system of claim 8 wherein each said pie-shaped base member is generally a 90° quadrant.

10. The shelf system of claim 8 wherein each said shelf member of said first set includes four of said upper leg cavities and four of said lower leg cavities with one upper and one lower leg cavity positioned in each corner to form a beveled corner portion for said shelf member, and each said shelf member of said second set includes three of said upper leg cavities and three of said lower leg cavities, with one upper and one lower leg cavity positioned in each corner to form a beveled corner portion for said shelf member.

11. The shelf system of claim 3 further including a third set of shelf members vertically spaced from each other by said leg members, wherein said shelf connecting means connects at least one shelf member of said first set to a horizontally adjacent shelf member of said third set.

12. A modular shelf system comprising:

a first set of shelf members vertically spaced from each other;

a second set of shelf members vertically spaced from each other;

a plurality of leg members coupled to said shelf members for spacing said shelf members from each other;

a shelf connecting means for connecting at least one shelf member of said first set to a horizontally adjacent shelf member of said second set, wherein each said shelf member is an integral, one-piece shelf member including a horizontal base member, a vertical side member surrounding a peripheral edge of said horizontal base member, wherein a top edge of said vertical side member is positioned above said horizontal base member, a plurality of upper leg cavities configured to receive those of said leg members therein which are coupled to said shelf member and positioned above said shelf member, and a plurality of lower leg cavities aligned with said upper leg cavities, said lower leg cavities configured to receive those of said leg members therein which are coupled to said shelf member and positioned below said shelf member;

wherein said shelf connecting means includes a generally inverted U-shaped clip fastened over said top edges of said clip of said side members of said horizontally adjacent shelf members;

wherein said horizontal base members of each said shelf member include at least one slot for receiving a portion of said clip; and further including at least one slidable drawer means coupled to one of said shelf members of said first set.

13. The shelf system of claim 12 wherein said slidable drawer means includes a pair of brackets attached to said vertical side member, each said bracket including a pair of attaching means for attaching said bracket to said shelf member with one attaching means at each end of said bracket and a shelf supporting groove running along the length of said bracket; and a drawer member slidably supported between said pair of brackets, said drawer member including a supporting flange at each side thereof, wherein each said supporting flange is slidably received in one said shelf supporting groove.

14. A slidable drawer adapted for attachment to a horizontal shelf member, said drawer comprising:

a pair of spaced brackets adapted to be attached to the horizontal shelf member, each said bracket including a pair of attaching means for attaching said bracket to the horizontal shelf member with one said attaching means at each end of said bracket, each said attaching means including an overlapping snap-on type connector positioned adjacent a substantially vertically extending locating flange, and a shelf supporting groove running along the length of said bracket; and a drawer member slidably supported between said brackets, said drawer member including a supporting flange at each side thereof, wherein each said supporting flange is slidably received in one said shelf supporting groove.

* * * * *

UNITED STATES PATENT AND TRADEMARK OFFICE

CERTIFICATE OF CORRECTION

PATENT NO. : 5,588,541

DATED : December 31, 1996

INVENTOR(S) : Charles R. Goetz

It is certified that error appears in the above-indentified patent and that said Letters Patent is hereby corrected as shown below:

Column 2 Line 45 "of portion" should read --of a portion--.

Column 2 Line 47 "molar" should read --modular--.

Claim 3 Line 42 Column 6 before "second" insert --said--.

Signed and Sealed this

Fifteenth Day of April, 1997

*Attest:*

*Attesting Officer*

BRUCE LEHMAN

*Commissioner of Patents and Trademarks*